US007214031B2

(12) United States Patent
Parrent

(10) Patent No.: US 7,214,031 B2
(45) Date of Patent: May 8, 2007

(54) APPARATUS AND METHOD FOR PROCESSING FLUIDS

(76) Inventor: Kenneth Gaylord Parrent, 148 E. Division, Fairfield, MT (US) 59436

( * ) Notice: Subject to any disclaimer, the term of this patent is extended or adjusted under 35 U.S.C. 154(b) by 0 days.

(21) Appl. No.: 10/982,959

(22) Filed: Nov. 5, 2004

(65) Prior Publication Data

US 2006/0239811 A1 Oct. 26, 2006

(51) Int. Cl.
*F04D 17/12* (2006.01)

(52) U.S. Cl. ..... 415/199.1; 415/211.2; 415/212.1

(58) Field of Classification Search ..... 415/211.2, 415/212.1, 224.5, 226, 225, 116, 199.1
See application file for complete search history.

(56) References Cited

U.S. PATENT DOCUMENTS 2,366,964 A * 1/1945 Howard ..... 415/199.3
4,815,929 A * 3/1989 Weinrib ..... 415/53.1

* cited by examiner

*Primary Examiner*—Ninh H. Nguyen

(57) ABSTRACT

An apparatus and a method for a versatile, multi-stage, centrifugal fluids-processing device adaptable to efficiently mixing, blending, emulsifying, deagglomerating or homogenizing fluids. The device comprises a centrifugal-pump-type mechanism comprising an electric motor, an intake screen, an elongate metal body, a central drive shaft extending from the motor to the discharge end of the device. Attached internally to the drive shaft is one impellor per stage, which by rotation of the motor, imparts kinetic energy to the fluid being processed. The fluid discharged from the impellors passes through separate conduits and opposing nozzles into opposite ends of a chamber having the internal shape of an oblate-spheroid with internally-ribbed ceramic walls. As the fluid streams being slightly divergent upon contact with each other they are mutually deflected at high-velocity and high turbulence to impact against the ribbed inner walls of the fluid processing chamber in directions away from the outlet from fluid processing. The orientation of the incoming fluid streams aids in providing optimum use of the fluid's kinetic energy in turbulence and high-sheer contact prior to the fluids exiting the fluid processing chamber.

2 Claims, 3 Drawing Sheets

APPARATUS AND METHOD FOR PROCESSING FLUIDS

BACKGROUND OF THE INVENTION

1. Field of the Invention

This invention relates to the general field of fluids mixing, blending, emulsifying, deagglomerating, and homogenizing by virtue of its method of utilizing fluid kinetics to achieve the above stated fluid processing objectives from one basic design and is most particularly concerned with an improved apparatus for conserving and efficiently utilizing kinetic energy invested in fluids during fluids processing activities. Said kinetic energy being continuously replenished at every stage within a continuous, multi-stage fluid-processing operation.

2. Description of the Prior Art

It is generally required, when processing fluids or fluidized substances, to achieve an end product of specified-quality and performance that said product have a high degree of homogeneity, i.e. that the particles of the various agglomerated ingredients are significantly reduced in size and thoroughly dispersed among each other. Frequently the specified degree of particle size reduction and/or dispersion requires the expenditure of much time and energy and can be achieved only by repetitious processing of individual batches of the ingredient(s) in some type of turbulence-and/or sheer-producing process or in a sequence of work-intensive, fluid-processing mechanical operations.

Conventional fluid processing such as blending, emulsifying, deagglomerating, and homogenizing operations and the like often disregard conventional wisdom that molecules vary greatly in size, physical complexity, electrical or magnetic characteristics, and the like, thereby frequently making their processing difficult. Also many substances have a phobia for other substances, yet their intimate combination may be desirable although very difficult to achieve. Additionally many substances are composed of molecules with a great affinity for each other, such as lubricants with high film-strengths. Such lubricants, for example, can be improved by being incorporated by blending, emulsifying or homogenization with certain other select components. Also certain solvents have characteristics that when mechanically combined with certain other fluids develop an enhanced molecular activity or stability thereby improving their contribution toward carrying a step in fluid processing to a desired end point more quickly, more thoroughly or more economically. A myriad of various fluid-processing activities are devoted to development of texture, color, stability, ingredient dispersion, viscosity control, chemical combinations and the like. The majority of methods employed in the fluid processing industry employ some type of rotating mechanism such as a propeller or multi-bladed mixer, or a fluid-jet to achieve an acceptable degree of sheer, particle dispersion, emulsification, deagglomeration or homogeneity. Traditionally achievement of product specifications may necessitate repetition of any of the foregoing steps in processing. Said repetition requires additional investment in time, labor, energy, plant equipment, floor space and the like. Still other types of fluid processors function by applying force to the process fluids to physically combine or deagglomerate said fluids between closely spaced, rotating, striated or perforated metal or ceramic surfaces. Still other methods used in fluids processing employ massive physical energy to force said fluids through very tiny openings or slits. Use of physical force is a traditional technique used in many fluid-processing operations. Development of force requires development of pressure, which requires energy, which costs money.

When correctly designed and applied to fluid processing the above methods of blending, emulsifying, deagglomerating, homogenizing, or the like, function acceptably, however, equipment users and manufacturers constantly seek to accomplish the above by reducing time requirements, simplifying operations, reducing maintenance, labor, energy, equipment costs, and the like. Conventional equipment for the above tasks is frequently massive, complex to operate, expensive to maintain, and energy intensive, as well as being a significant initial capital investment, therefore, it is the objective of the present invention to provide a method and an apparatus to mitigate many of the foregoing problems attending fluid processing by means of the prior art.

SUMMARY OF THE INVENTION

In a preferred embodiment described in the following, the objective of the present invention is to provide a method and an apparatus for improving fluids processing in various applications. Said invention significantly broadening its field of application by combining the effect of fluid acceleration through reduced-bore nozzles in accordance with Bemoulli's classic Theorem of "The Conservation of Energy", explained, for instance in "Fundamentals of Fluid Mechanics" by Munson, Young and Okiishi, John Wiley 1994, pgs. 101–163, and also by utilizing kinetic energy as specified in the likewise classic definition of the energy of a mass in motion, i.e. its kinetic energy, $E_K$, expressed by the relationship $$E_{K=mv}{}^2/2 \qquad 1.$$

wherein m equals the mass, v equals the velocity of the mass as is presented, i.e. in "Physics" by Hausman & Slack, published by Van Nostrand 1948, pg 121.

To explain: a first and a second stream of fluid approaching each other at an individual velocity of V possess a relative velocity with respect to each other of 2V in each fluid stream which, when substituted into equation 1 yields a 400% increase in kinetic energy in each of said two streams impinging on each other as shown below:

1. $E_K$ in said first stream=$mV^2/2$. $E_K$ in said second stream=$mV^2/2$.

As explained above: the relative velocity of two streams approaching each other at a velocity "V" equals a relative velocity of 2V in each stream; therefore, substituting 2V into equation 1 yields:

$$E_K=m(2V)^2/2=m(4V^2)/2$$

which equals 400% increase in $E_K$ (kinetic energy) in each stream.

The first level of kinetic energy in said fluid is provided by said rotating impellor imparting the initial velocity and, therefore, kinetic energy to said process fluid.

Additional fluid velocity and thus kinetic energy being achieved by acceleration of said fluid through nozzles having reduced interior diameter; as explained above. Still additional effective kinetic energy in said fluids being developed by virtual direct impingement of said separate streams of said accelerated fluid upon each other from opposite directions within a Parr Chamber to be described later. Optimum use of said kinetic energy being achieved partially by slightly divergent, high-energy contact of said first and said second fluid streams with each other within said Parr Chamber. Said divergent contact of said incoming streams is a means for causing said streams, after their initial high-velocity, high-kinetic-energy contact with each other to be partially diverted away from the exit opening of said Parr Chamber and into additional high-kinetic-energy high-velocity sheer, impact, deagglomeration and the like in confined turbulence within the internally-ribbed enclosure of said Parr Chamber; said processed fluid now being continually displaced from said Parr Chamber by continually incoming fluid. Said process fluid now being displaced from said Parr Chamber through said exit opening into conduit means leading to the intake side (sometimes called the diffuser) of the succeeding, rotating impellor means of said apparatus. Said rotating impellor means increasing pressure, velocity and thereby kinetic energy in said fluid being continually discharged there from through conduit means as previously described into succeeding Parr Chambers where above said fluid processing interactions are repeated in said sequential, multi-stage process until said fluid is finally discharged from said apparatus through said discharge opening.

Each stage in said multi-stage apparatus increases pressure on said process fluid. Said pressure increase permits reduction of the inside diameter of the succeeding nozzles, thereby causing an increase in fluid velocity as previously explained which, in turn increases said kinetic energy of said fluid particles, which in turn increases the ability of said fluid particles to do more work in providing greater sheer, improved blending, finer particle-size reduction, more thorough homogenization, more consistent particle-size reduction, finer deagglomeration and the like.

The combined beneficial effects of high-fluid velocities, very-high-level kinetic energy, high-sheer-energy, confined turbulence and multi-stage fluid processing are integrated in said invention to provide a more efficient, more versatile method and apparatus for fluids processing than hitherto available.

Other objectives, aspects or advantages of the present invention will be indicated or understood from the detailed description provided in the following, conjoined with the accompanying drawings.

DETAILED DESCRIPTION OF THE INVENTION

Figure 1:
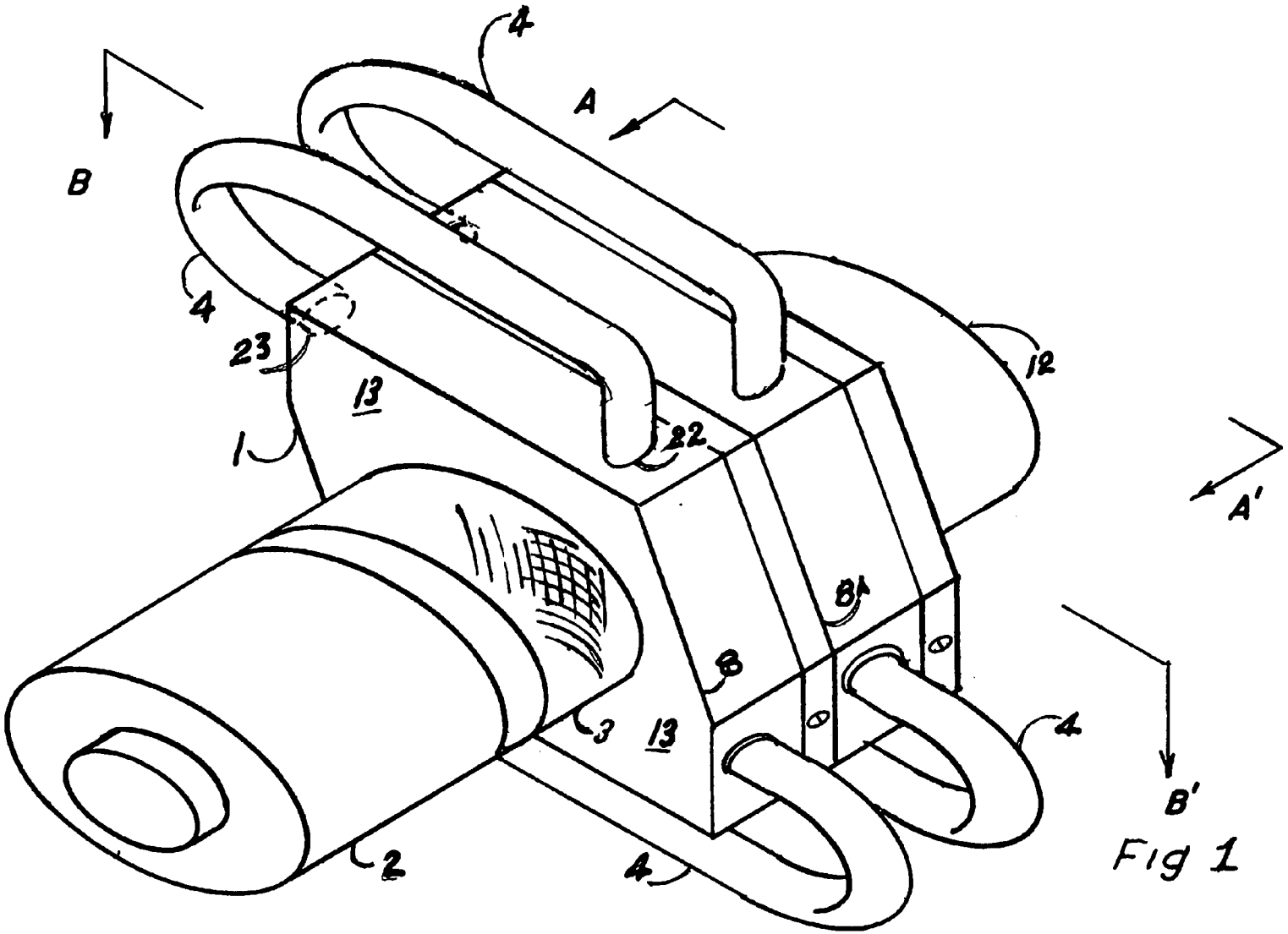
FIG. 1 is an external isometric view of one embodiment of the multi-stage fluid processor of the present invention showing the drive motor, intake screen, two impellor/diffuser housings, the discharge fitting and the external fluid conduits from the impellors to the Parr Chambers in accordance with the present invention.

Reference is made to FIG. 1 wherein there is shown in perspective one embodiment of an apparatus in accordance with the invention generally indicated at 1. Said assembly includes a prime mover 2 such as an electric motor which provides rotary motion to the internal impellors 14 & 14A, FIG. 2; a screen 3 to prevent unwanted debris from entering said devise; a discharge fitting 12 and external fluid conduits 4 to conduct fluid from said impellors 14 & 14A to their specific Parr Chambers 6 & 6A, FIG. 2 located internally at position 13, FIG. 1 within said impellor housings 7 & 7A, FIG. 2. Although for simplicity FIG. 1 depicts only two stages 8 & 8A, FIG. 1 of one embodiment of an apparatus in accordance with the invention, said device may be adapted to perform more thorough fluid processing or other types of fluid processing or its capacity increased by increasing its physical dimensions and/or by increasing the number of process stages, Parr Chambers on each stage and input horsepower. Said external fluid conduits 4 are commercially available metal tubing and may be augmented with commercially available piping, pumps, valves, and the like to receive at any stage, additional ingredients required by a specific process.

Referring again to FIG. 1 during operation of said device said process fluid enters said subject apparatus 1 though said screen 3 through which is provided said process fluid. Upon energizing said motor 2 said motor's instantaneous attendant rotary motion and direct mechanical connection via shaft 13, FIG. 2 to said impellors 14 & 14A within said subject device causes said first stage impellor 14 to take process fluid through screen 3 into said impellor's central area 9. All of said impellors when in operation rotate at the same selected speed depending upon the specifications of the final processed fluid. Said impellors being of standard design found in many commercially available submersible pumps are not described herein. Said process fluid having entered said impellor 14 as a result of said impellor 14 being provided with said process fluid. Said process fluid within said impellor 14 being accelerated within said impellor 14 by rotary motion of said impellor and discharged thereby from said central area 9 of said impellor 14 in a direction outward from said central area 9 of said impellor 14 toward said outer wall 16, FIG. 3 of said impellor housing 7. Said acceleration of said fluid increases the velocity of said fluid and thereby imparts kinetic energy (energy of motion) to all particles of said fluid. Said accelerated fluid now being moved outwardly from said central area 9 of said impellor 14 by virtue of centrifugal force imparted to said fluid by said rotary motion of said impellor 14. As said fluid moves away from said central area 9 of said impellor 14 a continuous flow of said process fluid moves through screen 3 into said central area 9 of said impellor 14 to replace said fluid moving outward from said central area 9. Said outwardly moving fluid exerts pressure against said inner wall 16, FIG. 3 of said impellor housing 7 where, upon intersecting a first of two related outlets 17 and 17A, FIG. 3 in said inner wall 16 of said impellor housing 7 a first portion of said fluid is discharged from said impellor 14 by centrifugal force into said first outlet 17 and onward into passage 19 of optimal inside diameter within said impellor housing 7 and thence onward into said first nozzle 20 of said Parr Chamber 6. Said first nozzle 20 being of smaller inside diameter than that of said passage 19 will result in said fluid accelerating within said first nozzle 20 as explained by Bemoulli's classic Theorem or as it is also called "The Conservation of Energy Equation" adequately explained for example in "Fundamentals of Fluid Mechanics" published in 1994 by John Wiley and Sons, pgs 101–163. Said first portion of said accelerated fluid particles being discharged from said first nozzle 20 into said Parr Chamber 6 possess increased kinetic energy resulting from their increased velocity caused by passing through said first nozzle 20 as explained in the above referenced text. The efficient employment of said kinetic energy is a primary objective of this invention as will be more fully disclosed in the following.

Figure 2:
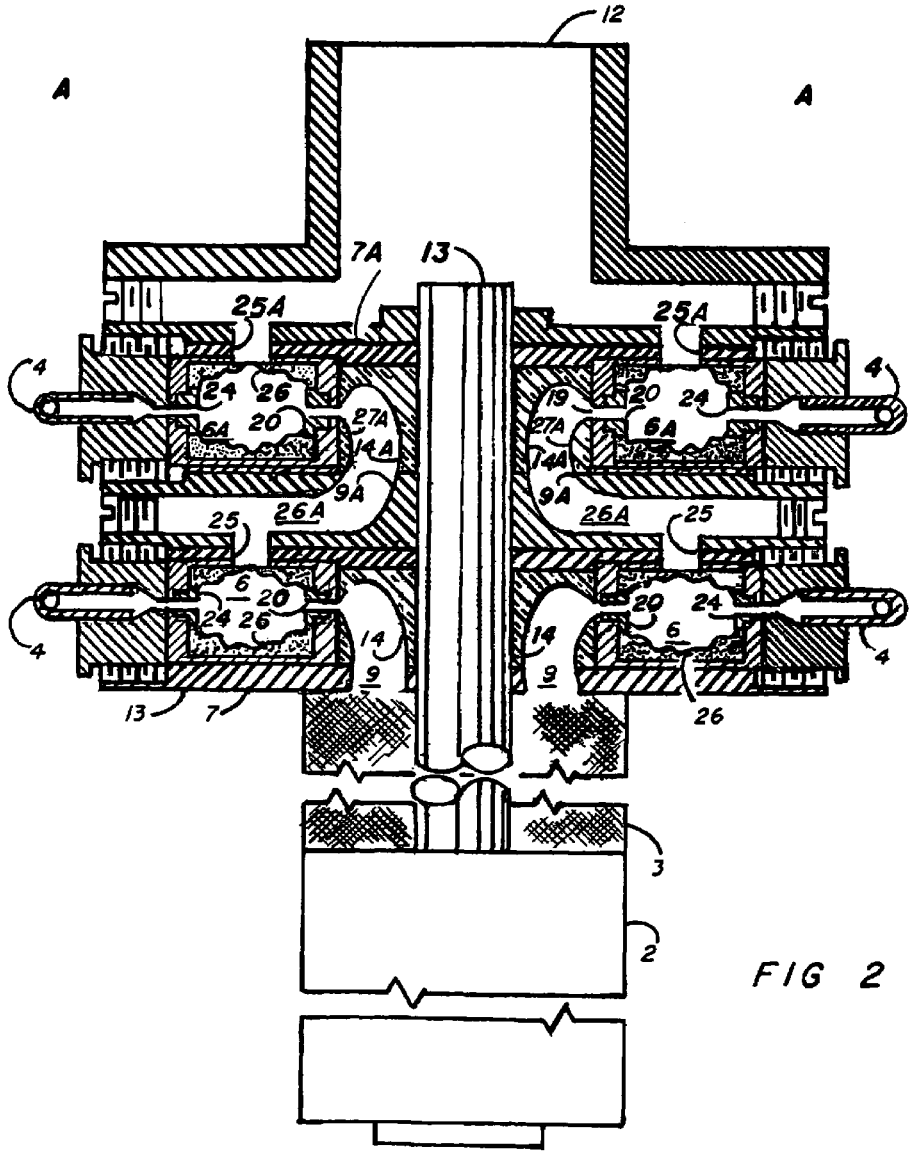
FIG. 2 is a partial cross-sectional view through section A–A[1] FIG. 1 exposing the configuration of two typical impellor/diffuser assemblies with two Parr Chambers installed within each impellor housing. Also shown are internal and external fluid passages from said impellors to said Parr Chambers and also shown is said discharge passage from each Parr Chamber to the intake side (the diffuser) of its succeeding impellor. Lastly shown is the discharge passage from the final Parr Chambers into said discharge fitting.
Figure 3:
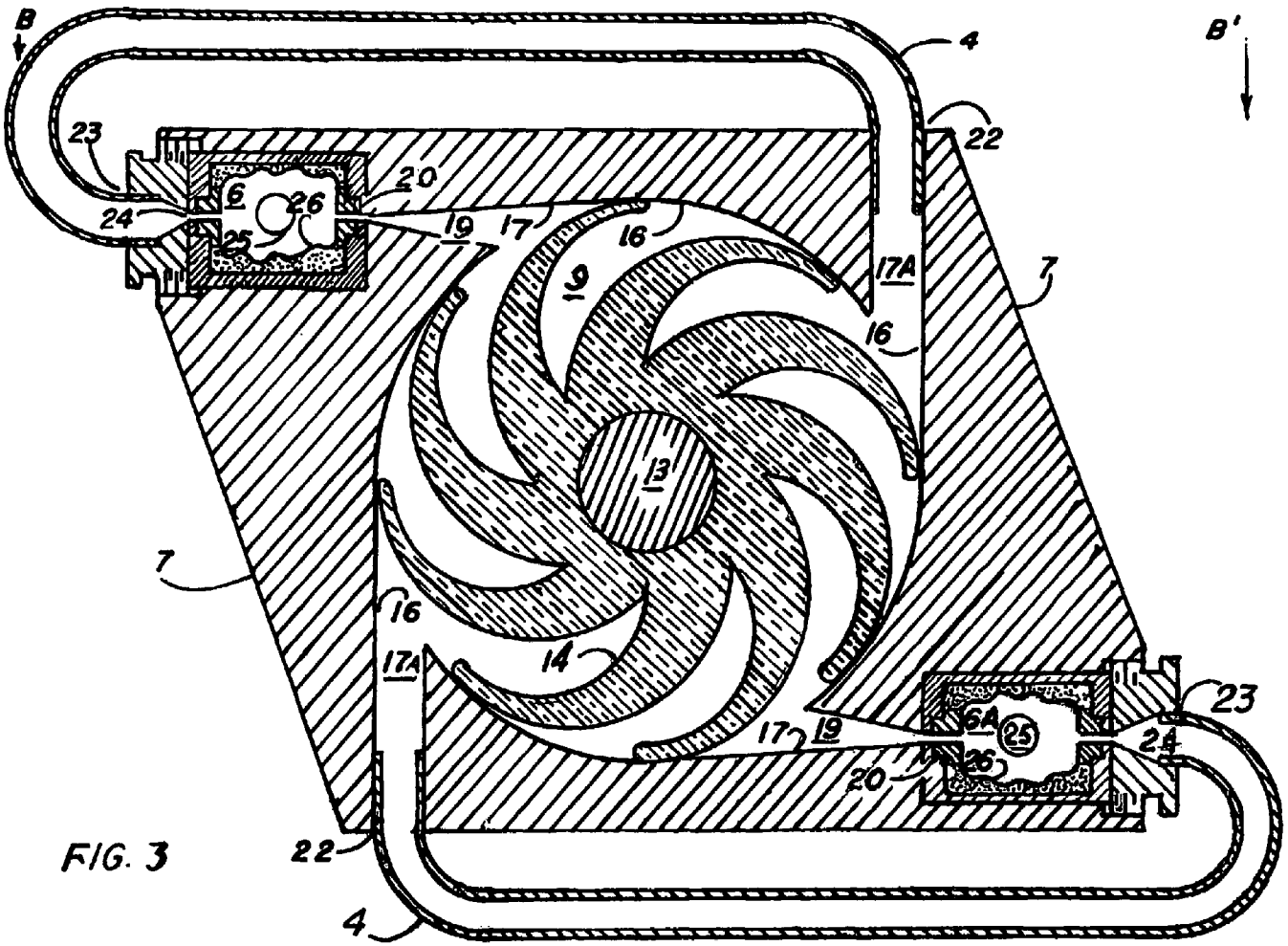
FIG. 3 is a cross-section of two Parr Chambers in position within their complimentary impellor housing, which is shown in cross-section.

Simultaneously to said first portion of said process fluid entering said first outlet 17, FIG. 3 a second portion of said process fluid is being forced into a second outlet 17A, FIG. 3 in said inner wall 16 of said impellor housing 7. Said second outlet is connected via external tubular conduit means 4, consisting of commercially available tubing and fittings attached by commercially available threaded means (not shown) at one end 22, FIGS. 1 & 3 to the outside of said impellor housing and at its other end 23, FIGS. 1 & 3 to its correlative nozzle assembly 24, FIG. 3 wherein said second portion of said fluid is accelerated as was explained for said first portion of said fluid passing through said first nozzle 20, FIG. 3 and thence into said Parr Chamber 6. Said second nozzle 24, FIG. 3 being aligned with and opposite to said first nozzle 20. The long axis of said nozzle 24 being offset by 10° (degrees) from the long axis of said first nozzle 20 in the orientation away from outlet 25 from said Parr Chamber. Said orientation of said nozzle 24 being chosen to cause deflection of said colliding, incoming, high-velocity-fluid streams in the direction opposite said exit 25 from said Parr Chamber. Said fluid deflection being necessary to counteract the tendency of said injected fluids to flow into the low-pressure exit 25 prior to expending a maximum amount of said fluids contained kinetic energy within said Parr Chamber by high-velocity sheer, turbulence and inter-particle collisions and collisions with said ribbed interior surfaces 26, FIGS. 2 & 3 of said Parr Chamber. The internal dimensions of said Parr Chamber limiting travel of the turbulent cloud of colliding, high-velocity fluid particles thereby maximizing the use of their effective velocities and turbulence and thereby the frequency and magnitude of said collisions and inter-practical sheer while optimally utilizing said kinetic energy possessed by said fluid particles to deagglomerate, disperse and otherwise produce a homogenous blend of consistently microscopic-sized particles in a continuous, high-energy, efficient, multi-stage process.

Upon being subjected to said high-velocity sheer, and inter-particle collisions and the like within said Parr Chamber said fluid transits said Parr Chamber through a stream of constantly incoming fluid from nozzles 20 & 24, FIG. 3 thereby experiencing additional high-velocity sheer, turbulence and the like while in transit to said exit opening 25, FIGS. 2 & 3. Upon exiting said Parr Chamber through said exit opening 25 said fluid transits passage 26A between impellor housings 7 & 7A; said passage 26A leading to the intake side 9A of the subsequent rotating impellor 27A which imbues said fluid with additional pressure, accelerates fluid movement and, thereby, increases its kinetic energy prior to said fluid being discharged by said impellor 27A into passage 19 and nozzle 20 into Parr Chamber 6A and simultaneously through nozzle 24 into said Parr Chamber whereupon the aforesaid fluid process is repeated as previously explained prior to said process fluid being discharged through outlet 25A and outward through the final outlet 12.

Said invention can be increased in capacity by increasing its dimensions which will permit adding additional Parr Chambers to its circumference and additional stages to its length. Such increases will require additional power and increased internal diameter, increased impellor diameter, increased drive-shaft diameter, increased inside diameter of the final discharge fitting 12 and optionally increased length. Each of said impellor stages increases said pressure, velocity and said kinetic energy in said fluid prior to said fluid exiting its complimentary impellor housing to proceed through its succeeding stage of high-kinetic-energy sheer and turbulence and the like in its succeeding Parr Chambers, whereupon the aforesaid process is repeated as previously explained until said process fluid is discharged from the device through outlet 12.

Additionally said increases in said pressure in said fluid passing through each of said stages of said device raises said pressure within said process fluid by approximately 10 pounds per square inch per stage. Said pressure increases permit reducing the inside diameter of succeeding nozzles which in turn provides increased fluid-particle velocities and increased kinetic energy in said fluid particles as previously described.

Said increased number of stages, with said attendant increases in pressure, decreased nozzle bores and increased fluid velocities provide additional kinetic energy to process-fluid particles which when exploited within Parr Chambers will yield ever finer deagglomeration and the like within said Parr Chambers. The resulting increased, improved deagglomeration and particle-size reduction within said subject invention provides, in addition to other benefits, an ideal premixed fluid for conventional homogenization. Although conventional rotational mixing devices can eventually provide an acceptably consistent fluid composed of well-dispersed small particles neither the sliding action of a propeller blade through a fluid, nor the relatively long travel distances of particles in turbulent fluids in a typical mixing vessel can provide the high degree of impact, sheer, deagglomeration and efficient use of kinetic energy that the present invention makes possible by the high-velocity, virtual direct inter-particle impact, sheer and turbulence developed within said Parr Chamber.

Although the invention has been described in the preceding embodiment, numerous changes and variations are intended to fall within the scope of the present invention. The limitations of the scope of the invention are not intended to be defined by the aforesaid description of the preferred embodiment, but rather by the following claims.

What is claimed is:

1. A method to maximize the utilization of Kinetic energy in very-high velocity fluids to improve the efficiency of processing one or multiple fluid substances simultaneously and continuously comprising the steps of:

a. providing a first-stage impellor within a first-stage impellor housing, within a centrifugal pump;

b. pumping a first stream of process fluid through an internal first passage means thence through a first nozzle means attached to a first reaction chamber means; said first reaction chamber means being installed within a first receptacle within the periphery of said first impellor housing;

c. simultaneously pumping a second stream of said process fluid utilizing said first impellor means within said first impellor housing of said centrifugal pump through a first external passage means thence through a second nozzle means into said first reaction chamber means; said second nozzle means being situated within the opposite end of said first reaction chamber means from said first nozzle means; said first and said second streams of process fluid entering said first reaction chamber means through said first and said second nozzles at very high velocity from virtually opposite directions;

d. enabling said fluid streams impacting against each other in a common plane at a divergent angle approximating 10 degrees, thereby causing optimum use of said kinetic energy in said two colliding, incoming fluid streams while simultaneously serving the purpose of offsetting said incoming streams of process fluid one from the other to cause said streams to effectively deflect each other away from an exit means from said first reaction chamber means; said deflection of said process fluid mitigating escape of said process fluid from said first reaction chamber means prior to said process fluid experiencing optimum utilization of said contained kinetic energy within said first reaction chamber means; said colliding streams of process fluid now experiencing high-velocity, inter-particle collisions, deagglomeration, shear and the like together with high-velocity shearing impacts with the interior surfaces of the ribbed ceramic lining means of said first reaction chamber means;

e. enabling the high-velocity fluid to pass through said exit means from said first reaction chamber means into fluid conduit means leading to a first diffuser means;

f. discharging the high-velocity fluid to a successive stage of the same configuration for further processing or discharging the fluid through an outlet.

2. A mechanical, elongate, hollow, metallic apparatus for processing fluid components comprising:

a prime mover, such as an electric motor, attached to either end of said apparatus; an inlet opening at either end of said apparatus through which process fluids may enter said apparatus into a first impellor;

an internal metal shaft extending throughout the length of said apparatus from said motor through a support bearing affixed to the opposite end of said apparatus;

said first impellor being affixed to said metal shaft by splined means or setscrews;

said apparatus being an assemblage of flat metal housings fabricated and assembled to alternately house one impellor each within a cylindrical bore;

said impellor housing being alternately to a diffuser housing or to said discharge fitting;

said diffuser housing subsequently being attached as above to a succeeding impellor housing;

each of said impellor housings including in its periphery one or multiple receptacles for a first reaction chamber;

each of said impellor housings including a first internal passage for conducting a first stream of said fluid from said impellor through a first nozzle into the internal end of said first reaction chamber;

said first impellor housing including a second internal conduit for conducting a second stream of said fluid from said first impellor to an inlet of an external tubular conduit secured to said impellor housing;

said external tubular conduit means now passing from its inlet end to its discharge end at an external inlet of said first reaction chamber;

said external conduit being secured at its discharge end to said first reaction chamber by threaded, hollow adaptor thereby allowing fluid passage from said external conductor means into said external end of said first reaction chamber though a second nozzle;

said hollow adaptor, securely retaining said first reaction chamber into its operating position within its receptacle within said periphery of said impellor housing;

wherein said first reaction chamber includes two opposed nozzles of which a first nozzle is located in the inner inlet end of said first reaction chamber a plus second nozzle located in the outer inlet end of said first reaction chamber; each of said nozzles passing a stream of fluid into said first reaction chamber in a plane common to both of said nozzles; the stream from the second nozzle being injected in the common plane at a divergent angle of ten degrees from the stream entering the first reaction chamber from the first nozzle; the divergent angle of the second stream deflecting the first stream and the second stream away from the outlet from said first reaction chamber;

said first reaction chamber possessing a ribbed interior lining composed of ceramic or hard metal such as tungsten carbide; said first reaction chamber including said outlet means from said first reaction chamber; said outlet means being located in the side of said first reaction chamber at an angle of ninety degrees perpendicular to said plane of said two incoming streams of said process fluid; said outlet means from said first reaction chamber communicating directly into a fluid conducting channel to direct said fluid from said first reaction chamber to fluid conducting channels in a first diffuser; and wherein said first diffuser channel subsequently directing said fluid into the central area of a subsequent impellor within a subsequent impellor housing wherein said process previously described is repeated in multiple, subsequent stages as may be required; or alternately said fluid being discharged from said apparatus through said discharge fitting.

* * * * *